US009169690B2

(12) United States Patent
Blair

(10) Patent No.: US 9,169,690 B2
(45) Date of Patent: Oct. 27, 2015

(54) WINDOW TREATMENT HAVING BACKLIGHTING

(71) Applicant: Lutron Electronics Co., Inc., Coopersburg, PA (US)

(72) Inventor: Edward J. Blair, Telford, PA (US)

(73) Assignee: LUTRON ELECTRONICS CO., INC., Coopersburg, PA (US)

( * ) Notice: Subject to any disclaimer, the term of this patent is extended or adjusted under 35 U.S.C. 154(b) by 104 days.

(21) Appl. No.: 13/827,186

(22) Filed: Mar. 14, 2013

(65) Prior Publication Data

US 2014/0262056 A1 Sep. 18, 2014

(51) Int. Cl.
*E05F 15/20* (2006.01)
*E06B 9/24* (2006.01)
*E06B 9/68* (2006.01)

(52) U.S. Cl.
CPC ... *E06B 9/24* (2013.01); *E06B 9/68* (2013.01); *E06B 2009/247* (2013.01); *E06B 2009/6827* (2013.01)

(58) Field of Classification Search
CPC ... Y02B 80/50; E06B 2009/6827; E06B 9/24; E06B 9/68; E06B 2009/247
USPC ..... 160/2, 5, 10, 127, 405, 238, 23.1, 26
See application file for complete search history.

(56) References Cited

U.S. PATENT DOCUMENTS 4,221,255 A * 9/1980 Barkemeyer ..... 160/197
4,497,515 A * 2/1985 Appelson ..... 296/141
5,066,085 A * 11/1991 Gimbutas et al. ..... 385/115
5,148,849 A * 9/1992 Faludy ..... 160/67
5,355,604 A * 10/1994 Rathke ..... 40/601
5,467,266 A 11/1995 Jacobs et al.
6,084,231 A * 7/2000 Popat ..... 250/214 AL
6,181,089 B1 1/2001 Kovach et al.
6,212,805 B1 * 4/2001 Hill ..... 40/443
6,497,267 B1 12/2002 Azar et al.
6,983,783 B2 1/2006 Carmen, Jr. et al.
7,085,627 B2 8/2006 Bamberger et al.
7,185,693 B1 * 3/2007 Hines ..... 160/327
7,374,315 B2 5/2008 Dorsey et al.
7,389,806 B2 6/2008 Kates
7,398,816 B2 * 7/2008 Sala ..... 160/368.1
7,417,397 B2 8/2008 Berman et al.
7,537,041 B2 * 5/2009 Spencer ..... 160/126
7,566,137 B2 * 7/2009 Veskovic ..... 362/1
7,617,857 B2 11/2009 Froese
7,950,827 B2 5/2011 Veskovic
7,977,904 B2 * 7/2011 Berman et al. ..... 318/480
8,339,085 B2 * 12/2012 Feldstein et al. ..... 318/470
8,339,086 B2 * 12/2012 Feldstein et al. ..... 318/470
8,417,388 B2 * 4/2013 Altonen et al. ..... 700/278

(Continued)

*Primary Examiner* — Katherine Mitchell
*Assistant Examiner* — Johnnie A Shablack
(74) *Attorney, Agent, or Firm* — Condo Roccia Koptiw LLP

(57) ABSTRACT

A window treatment can include a headrail that is configured to be mounted to a structure. A covering material can be attached to the headrail and configured to be raised and lowered. The window treatment can also include a bottom bar that is attached to an opposite end of the covering material as the headrail. The window treatment can also include a light source that is configured to illuminate a side of the covering material when the covering material is in a lowered position. In this manner, the light source may be configured to adjust the transparency level of the covering material to thereby adjust the privacy settings of the interior space that is enclosed by the window treatment.

13 Claims, 13 Drawing Sheets

(56) References Cited

U.S. PATENT DOCUMENTS

| | | | | |
|---|---|---|---|---|
| 8,571,719 | B2 * | 10/2013 | Altonen et al. | 700/287 |
| 8,720,524 | B2 * | 5/2014 | Spencer | 160/126 |
| 8,941,322 | B2 * | 1/2015 | Birru | 315/291 |
| 2006/0082987 | A1 * | 4/2006 | Dorsey et al. | 362/103 |
| 2007/0056697 | A1 * | 3/2007 | Chen | 160/310 |
| 2007/0277937 | A1 * | 12/2007 | Su | 160/98 |
| 2008/0121349 | A1 * | 5/2008 | De La Cruz | 160/23.1 |
| 2008/0190571 | A1 * | 8/2008 | Wimmer | 160/310 |
| 2008/0271856 | A1 * | 11/2008 | Paulussen et al. | 160/127 |
| 2011/0029136 | A1 * | 2/2011 | Altonen et al. | 700/275 |
| 2011/0102879 | A1 * | 5/2011 | De Ruijter et al. | 359/290 |
| 2011/0126992 | A1 * | 6/2011 | Yordanova | 160/127 |
| 2011/0192551 | A1 * | 8/2011 | Rance | 160/127 |
| 2011/0220299 | A1 * | 9/2011 | Berman et al. | 160/5 |
| 2012/0053731 | A1 * | 3/2012 | Feldstein et al. | 700/275 |
| 2012/0103540 | A1 * | 5/2012 | Shaffer et al. | 160/237 |
| 2012/0261078 | A1 * | 10/2012 | Adams et al. | 160/6 |
| 2014/0110065 | A1 * | 4/2014 | Beland et al. | 160/66 |
| 2014/0137381 | A1 * | 5/2014 | Worthman et al. | 29/401.1 |

* cited by examiner

WINDOW TREATMENT HAVING BACKLIGHTING

BACKGROUND

Window treatments typically include a flexible fabric or other means for covering a window in order to block or limit the daylight entering a space and to provide privacy. However, the privacy may be affected by the amount of light within the space or the amount of daylight on the outside. As such, the covering may allow for a level of transparency in certain situations, which may be beneficial or detrimental. For example, if the amount of light within the space is less than the amount of daylight on the outside, then an individual on the inside may be able to see through the covering and visually detect objects on the outside, which may be beneficial. However, if the amount of light within the space is greater than the amount of daylight on the outside, then an individual on the outside may be able to see through the covering and visually detect objects within the space, which may be undesirable.

Accordingly, it is desirable to decrease the level of transparency for the person on the outside, so that the person on the outside may have more difficulty seeing through the covering to visually detect objects within the space.

SUMMARY

The present invention provides a window treatment allowing for adjustable privacy settings by illuminating a light that is mounted to the structure or the window treatment.

In accordance with an embodiment, a window treatment may be configured to selectively cover a window that separates an exterior space from an interior space. The window treatment may include a headrail that is elongate along a first direction. The headrail may be configured to be coupled to a structure adjacent the window within the interior space. The window treatment may also include a covering material having a top end and a bottom end that is spaced from the top end along a second direction that is perpendicular to the first direction. The top end of the covering material may be operatively attached to the headrail such that the covering material is movable along the second direction between a raised position and a lowered position. The covering material may further have a first side and a second side that is opposite the first side and faces the window when the headrail is coupled to the structure. The window treatment may also include a light source configured to illuminate at least a majority of the second side of the covering material when the covering material is in the lowered position to thereby cause ambient light on the second side of the covering material to be greater than that on the first side of the covering material.

In accordance with another embodiment, a window treatment may be configured to selectively cover a window that separates an exterior space from an interior space. The window treatment may include a headrail that is elongate along a first direction and is configured to be coupled to a structure adjacent the window within the interior space. The window treatment may also include a covering material having a top end and a bottom end that is spaced from the top end along a second direction that is perpendicular to the first direction. The top end of the covering material may be operatively attached to the headrail such that the covering material is movable along the second direction between a raised position and a lowered position. The covering material may further have a first side and a second side that is opposite the first side and faces the window when the headrail is coupled to the structure. The window treatment may also include a light source coupled to at least one of the headrail and the covering material. The light source may be configured to illuminate at least a portion of the second side of the covering material.

During a specified astronomical time range, the covering material may be configured to have a first transparency whereby visualization through the covering material from the exterior space is permitted and a second transparency whereby visualization through the covering material from the exterior space is impeded relative to the first transparency. The covering material may be configured to have the second transparency when the light source illuminates the at least a portion of the second side of the covering material during the specified astronomical time range.

In accordance with another embodiment, a window treatment may be configured to selectively cover a window that separates an exterior space from an interior space. The window treatment may include a roller tube that is elongate along a first direction and is configured to be rotatably coupled to a structure adjacent the window within the interior space. The window treatment may include a covering material having a top end and a bottom end that is spaced from the top end along a second direction that is perpendicular to the first direction. The top end of the covering material can be operatively attached to the roller tube such that the covering material is movable along the second direction between a raised position and a lowered position. The covering material may further have a first side and a second side that is opposite the first side and faces the window when the roller tube is rotatably coupled to the structure. The window treatment may also include a light source configured to illuminate at least a majority of the second side of the covering material when the covering material is in the lowered position to thereby cause ambient light on the second side of the covering material to be greater than that on the first side of the covering material.

In another embodiment, the disclosure includes a method of adjusting the transparency of a covering material of a window treatment that covers a window. The window can separate an interior space from an exterior space. The window treatment can be mounted to a structure adjacent the window within the interior space such that the covering material has a first side and a second side that is opposite the first side and faces the window. The method can include lowering the covering material from a raised position to a lowered position such that the covering material covers a substantial portion of the window. The covering material can have a transparency such that during a time range after sunset and before sunrise visualization through the covering material from the exterior space is permitted. The method can also include adjusting an illumination level of a light source that is attached to the window treatment such that ambient light on the second side of the covering material is greater than that on the first side of the covering material. The method can also include, during the time range, causing visualization through the covering material from the exterior space to be impeded.

BRIEF DESCRIPTION OF THE DRAWINGS

The foregoing summary, as well as the following detailed description of an example embodiment of the application, will be better understood when read in conjunction with the appended drawings, in which there is shown in the drawings example embodiments for the purposes of illustration. It should be understood, however, that the application is not limited to the precise arrangements and systems shown. In the drawings.

DETAILED DESCRIPTION OF ILLUSTRATIVE EMBODIMENTS

Figure 1:
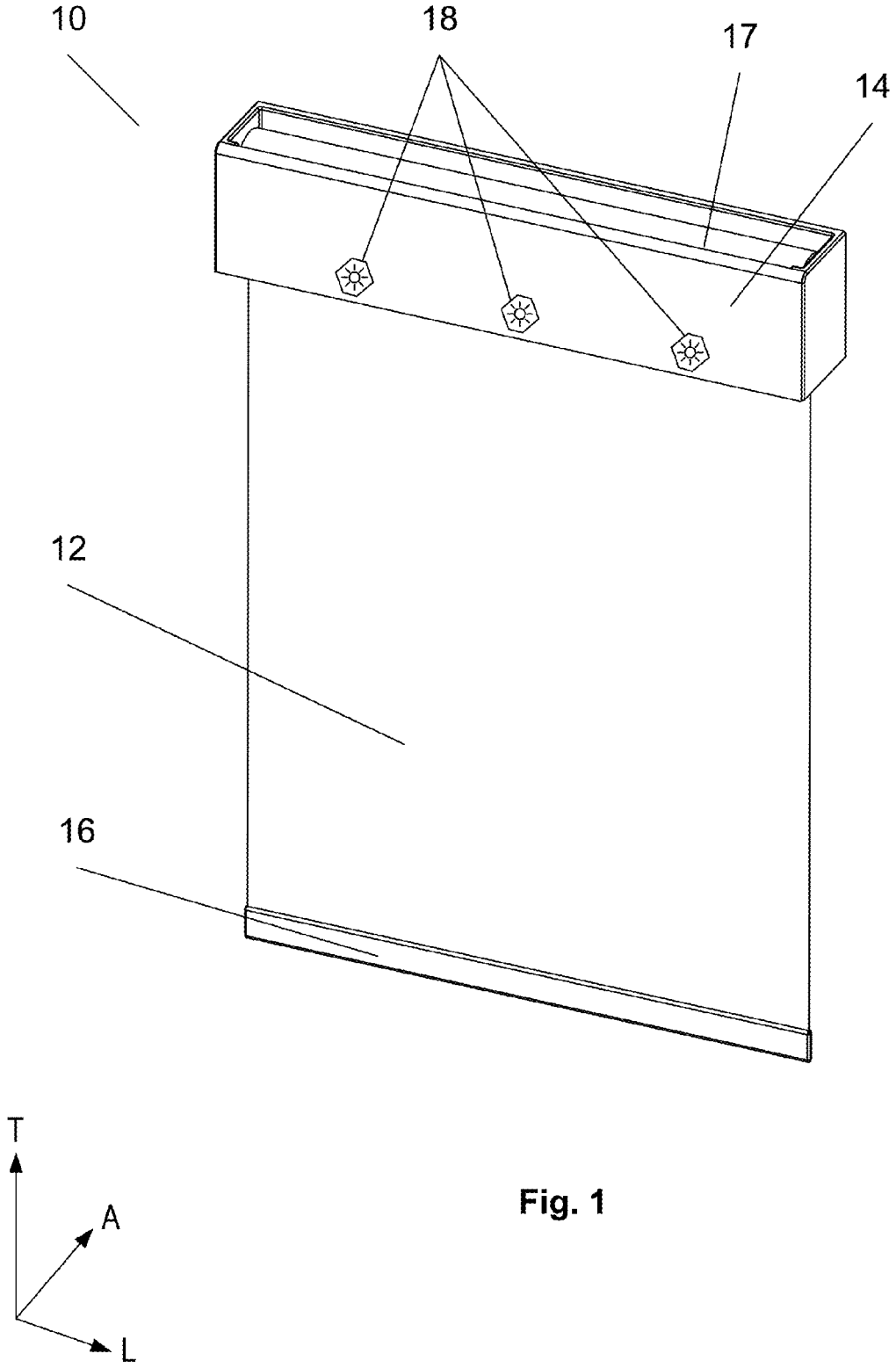
FIG. 1 is a backside perspective view of a window treatment in accordance with an embodiment, the window treatment including a headrail, a bottom bar, a covering material attached to the headrail at a top end and to the bottom bar at a bottom end, and a light source configured to illuminate at least a majority of a second side of the covering material when the covering material is in a lowered position to thereby cause ambient light on the second side of the covering material to be greater than that on a first side of the covering material.

Certain terminology is used in the following description for convenience only and is not limiting. The words "right", "left", "lower", "upper", "top", or "bottom" designate directions in the drawings to which reference is made. The words "proximally" and "distally" refer to directions toward and away from, respectively, the individual operating the display unit. The terminology includes the above-listed words, derivatives thereof and words of similar import.

Referring to FIGS. 1, 2A-2C, 3A-3B, and 4A-4C, a window treatment 10 can be configured to be coupled to or otherwise mounted to a structure 28, such as a window frame, wall, or other structure as desired. The window treatment 10 can be customized to have any desired size, shape, and/or aesthetic look. The window treatment 10 can be configured to have an internal mount (e.g. mounted within a window frame) or an external mount (e.g. mounted to the wall above the window frame). It should be appreciated, however, that the window treatment 10 can be configured to have any type of mount as desired. It should also be appreciated that the window treatment 10 can be mounted to the structure 28 via any type of mounting system that is configured to support a window treatment. In the embodiment illustrated in FIG. 2A, the window treatment 10 can be attached to the structure 28 and mounted to selectively cover a window 20. The window 20 and the structure 28 separate an interior space from an exterior space. The interior space is defined as the space inside the structure 28 that is enclosed from the exterior space. The exterior space is defined as the space outside the structure 28.

The window treatment 10 can include a headrail 14 that is elongate along a first or longitudinal direction L. The headrail 14 can be configured to be mounted to the structure 28. The window treatment 10 can further include a bottom bar 16 (e.g. a weighting element), a covering material 12 having a first end that is attached to the headrail 14 and a second end that is attached to the bottom bar 16. The covering material 12 can be a roller shade material as illustrated that hangs in front of the window 20 and is adjustable between a fully-open position and a fully-closed position to control the amount of daylight entering the interior space. As shown in FIG. 1, the window treatment 10 can further include a light source 18 that can be coupled to the headrail 14 and configured to illuminate the covering material 12 to adjust the transparency level of the covering material 12. In this manner, the light source 18 can be configured to adjust the privacy of the interior space. As will be discussed further, it should also be appreciated that the light source 18 can be coupled to any other feature of the window treatment 10, structure 28, or window 20.

The covering material 12 has a top end connected to the headrail 14 and a bottom end that is spaced from the top end along a second or transverse direction T that is perpendicular to the first direction L. The bottom end of the covering material 12 is attached to the bottom bar 16 such that the bottom bar 16 is elongate along the first direction L. The covering material 12 can be configured to hang in front of the window 20 and is adjustable between a fully-open position and a fully-closed position to control the amount of daylight entering the interior space. The covering material 12 can further have a first side and a second side that is opposite the first side, such that the second side of the covering material 12 faces the window 20 when the headrail 14 is coupled to the structure 28 and the covering material 12 is in a lowered position. It should be appreciated that the covering material 12 is not limited to roller shades as illustrated, and can be any type of material that is able to cover a window, or other structure, such as, for example, a cellular shade fabric, roman shade fabric, pleated blinds and Venetian or Persian blinds.

Figure 2A:
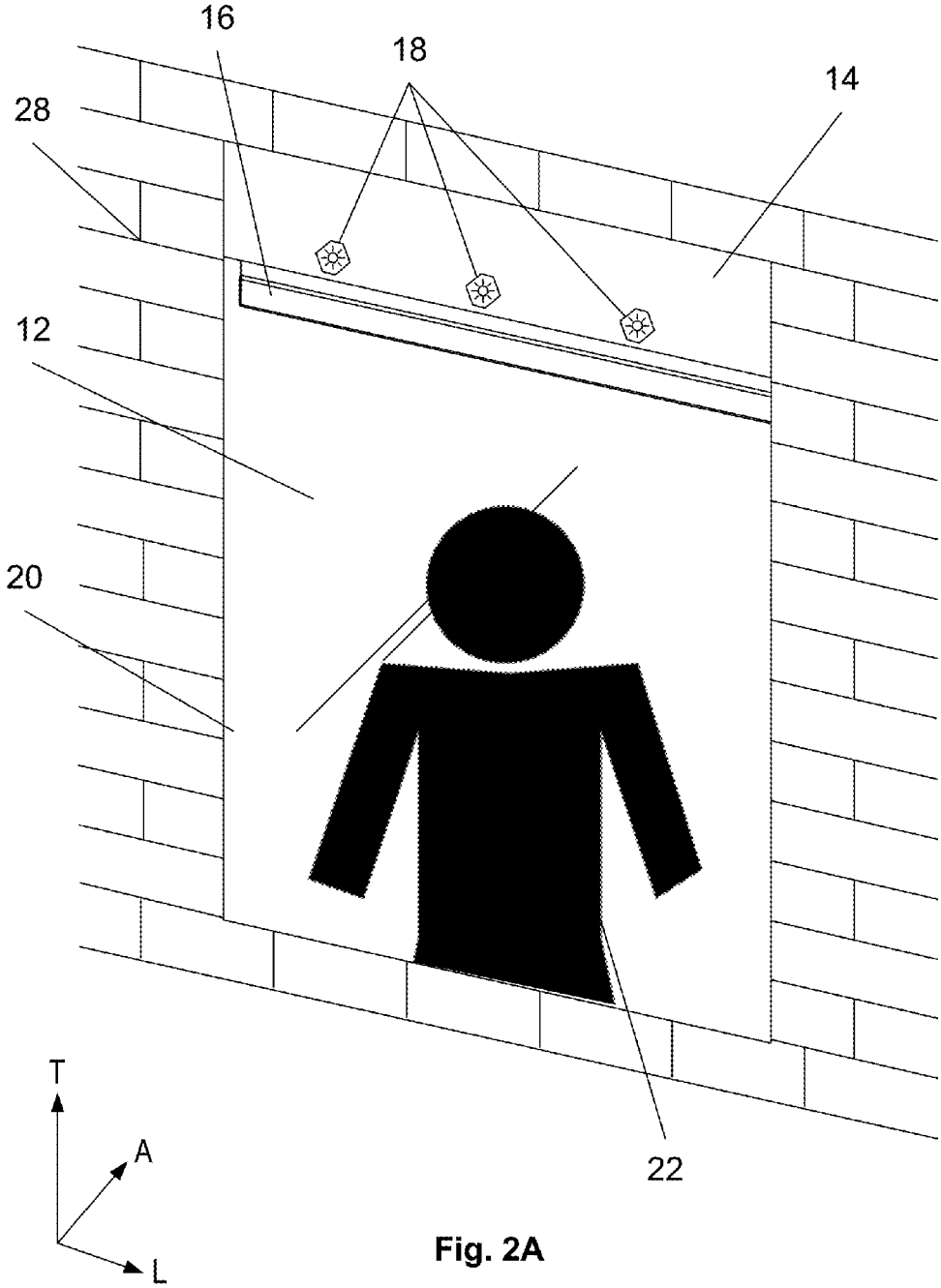
FIG. 2A is a backside perspective view of the window treatment as shown in FIG. 1, further mounted to a structure, adjacent to a window that separates an interior space from an exterior space, and with the covering material in a raised position.
Figure 2B:
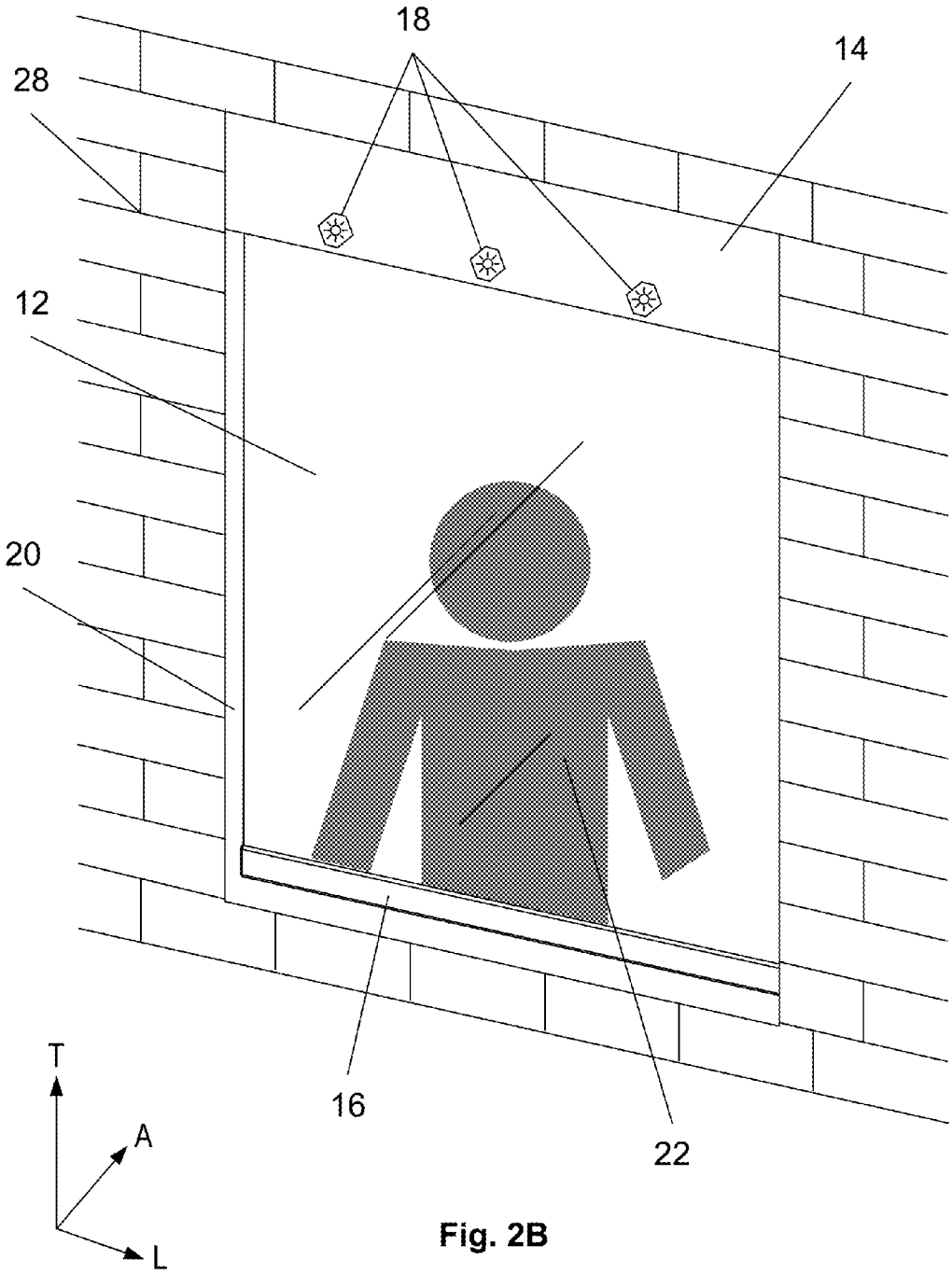
FIG. 2B is a backside perspective view of the window treatment as shown in FIG. 2A with the covering material in the lowered position such that the second side faces the window and with the ambient light on the second side of the covering material being less than that on the first side of the covering material.

As illustrated in FIG. 2A, the covering material 12 and the bottom bar 16 can be raised along the second direction T towards the headrail 14. In this manner, the interior space of the structure 28 may be visualized from the exterior space, as illustrated by the visualization of a user 22 within the interior space from the exterior space. As shown in FIG. 2B, the covering material 12 and the bottom bar 16 can be lowered along the second direction T away from the headrail 14 such that the covering material 12 covers a substantial portion of the window 20. In this manner, the covering material 12 can be used to impede visualization within the interior space of the structure 28 from the exterior space. However, if ambient light in the exterior space is less than that of the interior space, as illustrated in FIG. 2B, then visualization through the covering material 12 from the exterior space to the interior space may be permitted.

While not illustrated, it should also be appreciated that some embodiments may optionally include a headrail 14. As such, the window treatment 10 can include a roller tube that is elongate along a first direction. The roller tube can be configured to be rotatably coupled to the structure adjacent the window and the top end of the covering material can be operatively attached to the roller tube. In this manner, when the roller tube is rotated in a first rotation and in a second rotation, the covering material can be movable along the second direction between a raised position and a lowered position, respectively.

Figure 2C:
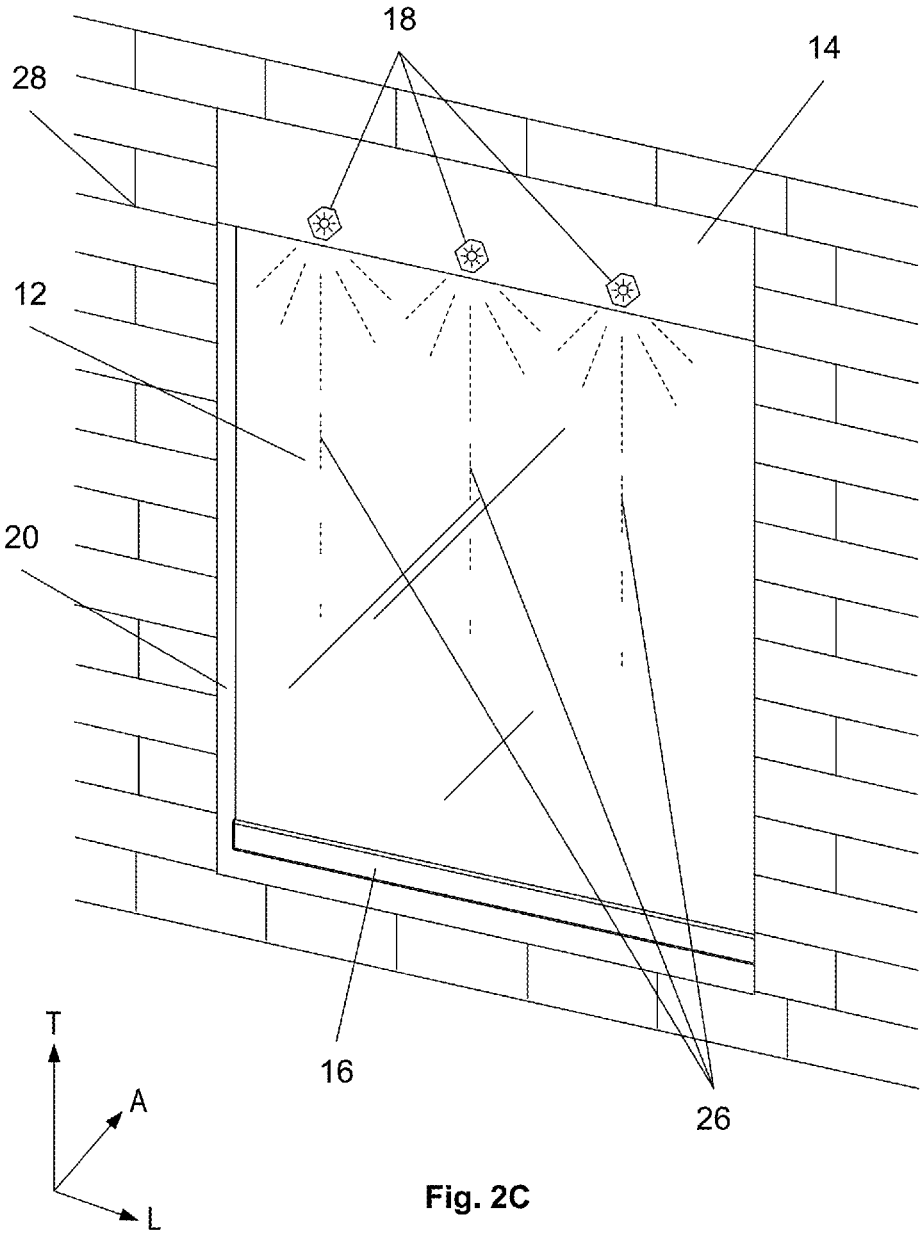
FIG. 2C is a backside perspective view of the window treatment as shown in FIG. 2B with the light source illuminated such that the ambient light on the second side of the covering material is greater than that on the first side of the covering material.

As shown in FIGS. 2A-2C, the light source 18 can be coupled to the headrail 14 such that the light source 18 is located between the covering material 12 and the window 20 when the headrail 14 is attached to the structure. It should be appreciated, that the light source 18 can be located between the window 20 and the covering material 12, whether the light source 18 is attached to the headrail 14, the covering material 12, the bottom bar 16, or the structure itself. It should further be appreciated that the light source 18 can be located between the window 20 and the covering material 12 whether the light source 18 is coupled within an internal cavity of the headrail 14 or to an external surface of the headrail 14.

The light source 18 can be any type of light that is capable of illuminating the second side of the covering material 12. For example, the light source 18 can include a plurality of light emitting diodes. It should be appreciated, however, that the light source 18 can include other types of lighting elements such as a fluorescent light, a halogen light, a neon light, a compact fluorescent lamp, or an incandescent light. It should further be appreciated that the light source 18 can be any combination of lights.

As shown in FIG. 2C, the light source 18 can be configured to illuminate at least a majority of the second side of the covering material 12 when the covering material 12 is in the lowered position such that visualization through the covering material 12 from the exterior space to the interior space is impeded. That is, the light source 18 may be configured to illuminate at least 51% of the second side of the covering material, preferably at least 75% of the second side of the covering material 12, and even more preferably about 100% of the second side of the covering material 12 when the covering material 12 is in the lowered position. It should be appreciated, however, that the light source 18 may be configured to illuminate any percentage of the second side of the covering material 12 when the covering material 12 is in the lowered position. The light source 18 can thereby cause an ambient light 46 on the second side of the covering material 12 to be greater than that on the first side of the covering material 12. In this manner, the light source 18 can be configured to adjust the privacy settings for the interior space. As such, the covering material 12, when in a lowered position, can be configured to permit and impede visualization through the covering material 12 based on the amount of light on the first side and the second side of the covering material 12.

If the amount of the ambient light 46 on the second side of the covering material 12 is less than the amount of light on the first side of the covering material 12, then visualization from the exterior space into the interior space may be permitted as illustrated by the visualization of the of the user 22 in the interior space, as shown in FIG. 2B. In this way the covering material can have a first transparency whereby visualization through the covering material from the exterior space to the interior space is permitted.

If the amount of light on the second side of the covering material 12 is greater than the amount of light on the first side of the covering material 12, then visualization from the exterior space into the interior space may be impeded as illustrated in FIG. 2C by the absence of the image of the user 22 in the interior space. In this way the covering material can have a second transparency whereby visualization through the covering material from the exterior space to the interior space is impeded relative to the first transparency. It should be appreciated, that when the covering material has the second transparency, visualization through the covering material can be completely impeded as illustrated, or slightly impeded such that the transparency of the covering material is less than that of the first transparency.

Figure 3A:
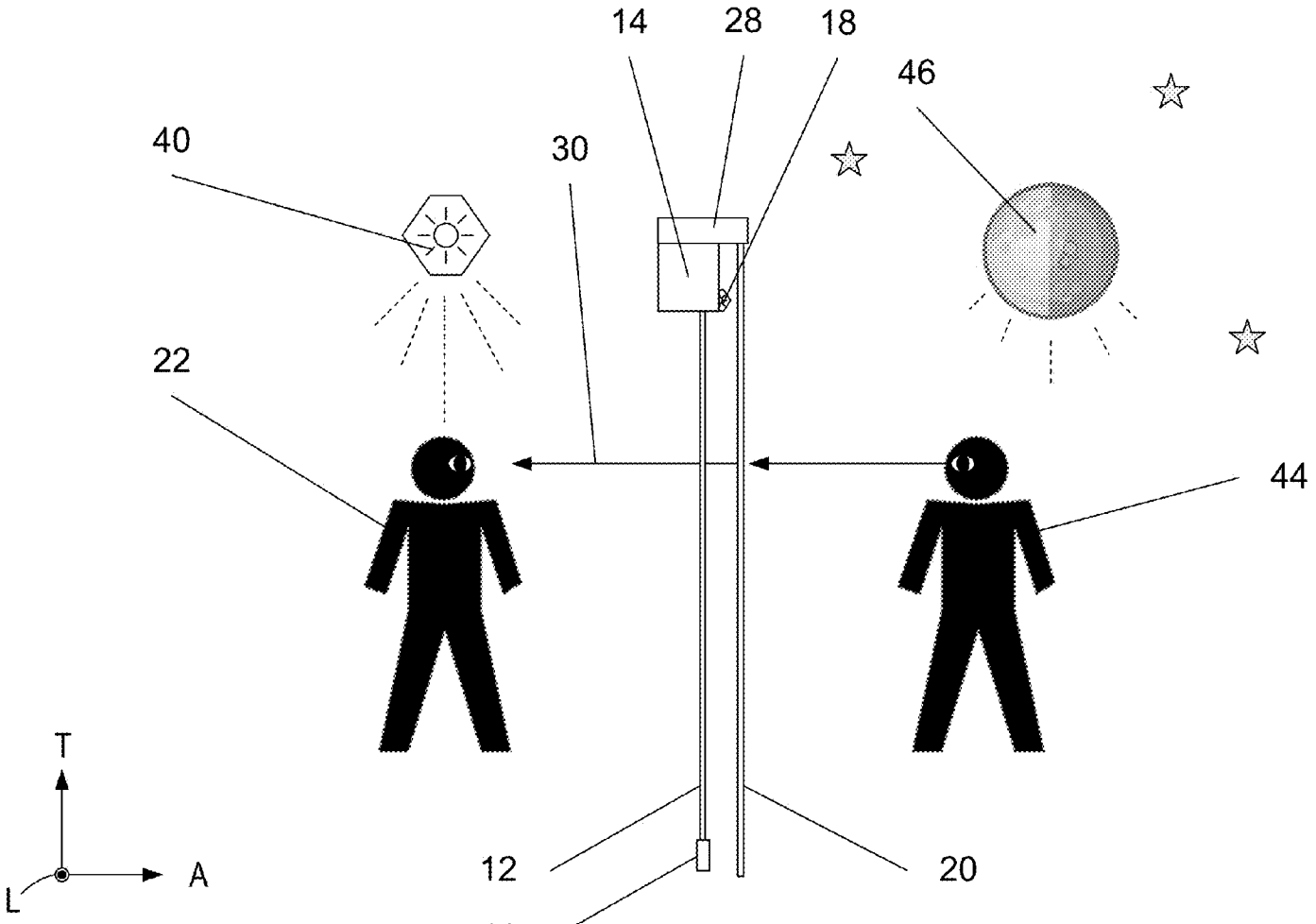
FIG. 3A is a side view of the window treatment, further illustrating that when the ambient light on the first side of the covering material is greater than the ambient light on the second side visualization through the covering material from an exterior space to an interior space is permitted.
Figure 3B:
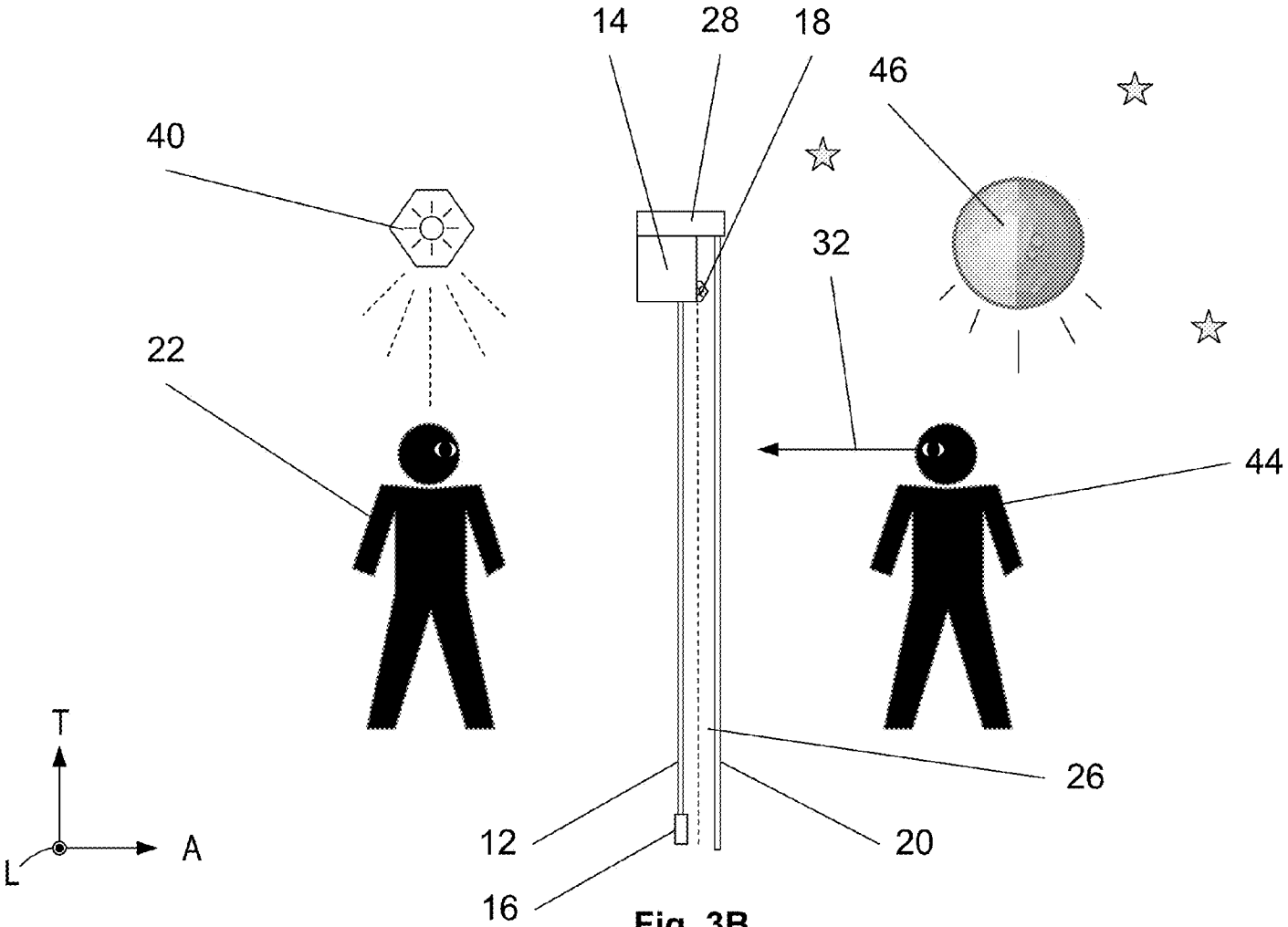
FIG. 3B is a side view of the window treatment, further illustrating that when the light source is activated, the ambient light on the first side of the covering material is less than the ambient light on the second side such that visualization through the covering material from the exterior space to the interior space is impeded.
Figure 4A:
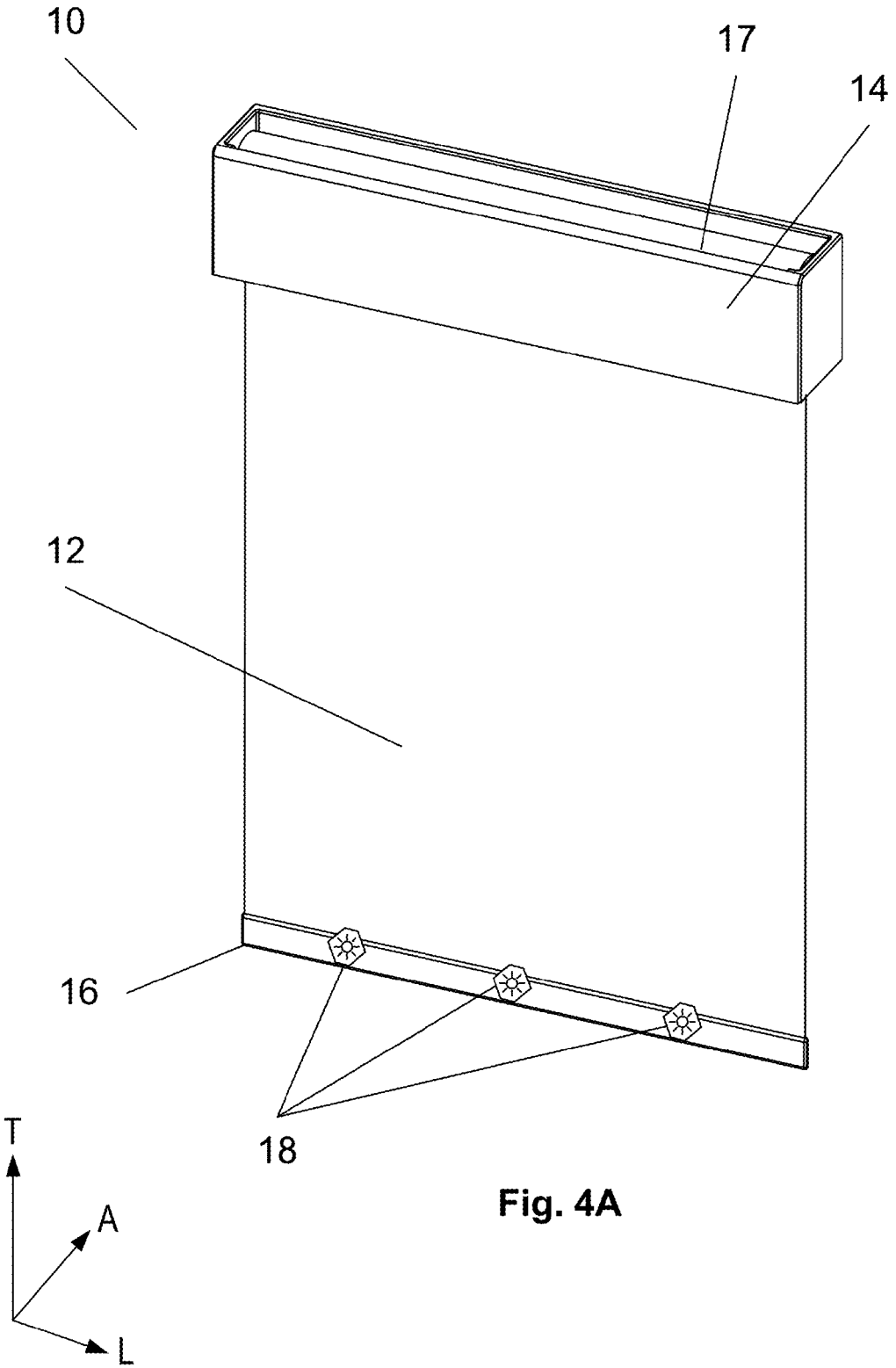
FIG. 4A is a backside perspective view of another embodiment of a window treatment with the light source attached to the bottom bar.
Figure 4B:
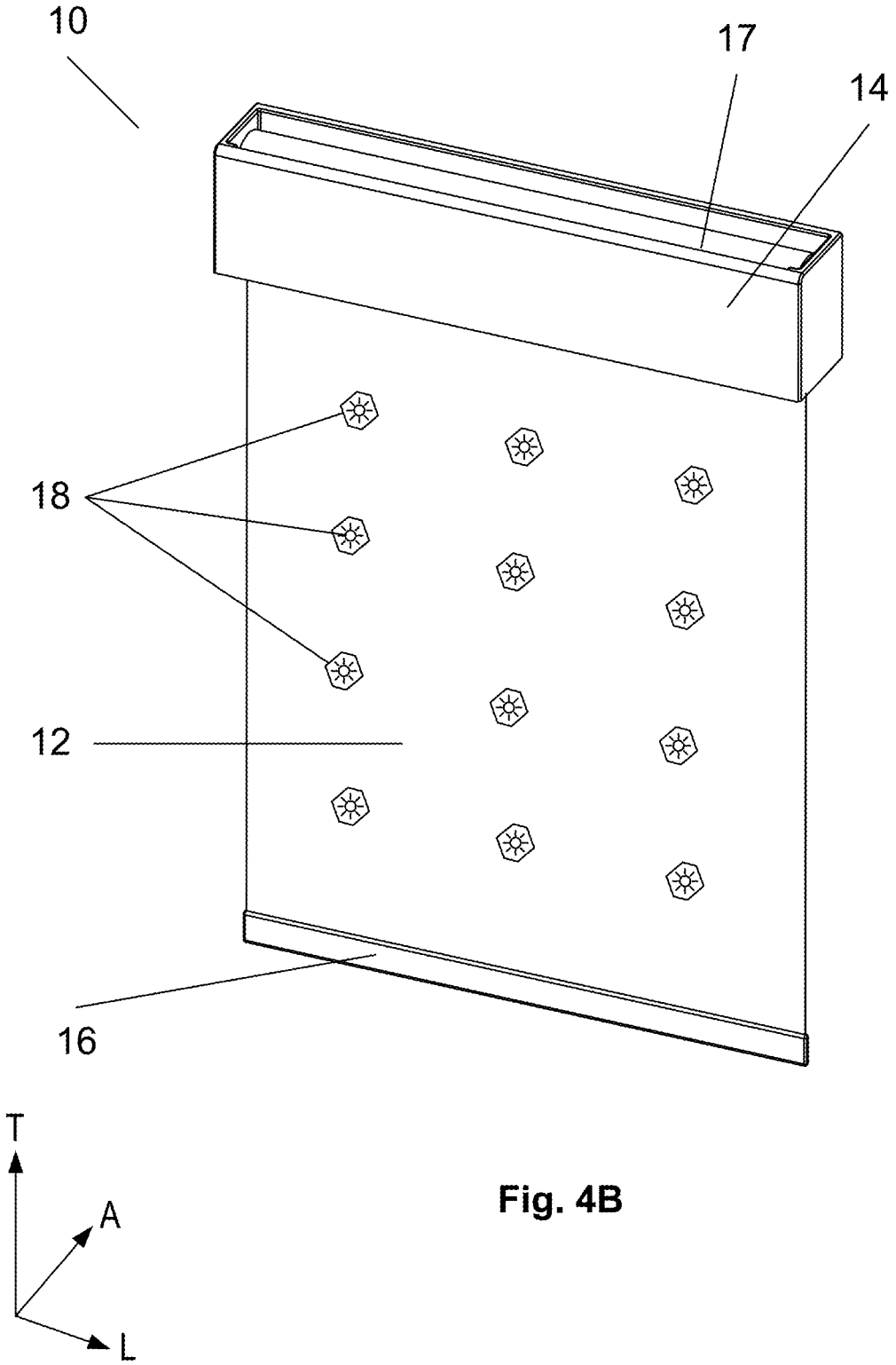
FIG. 4B is a backside perspective view of another embodiment of a window treatment with the light source attached to the covering material.
Figure 4C:
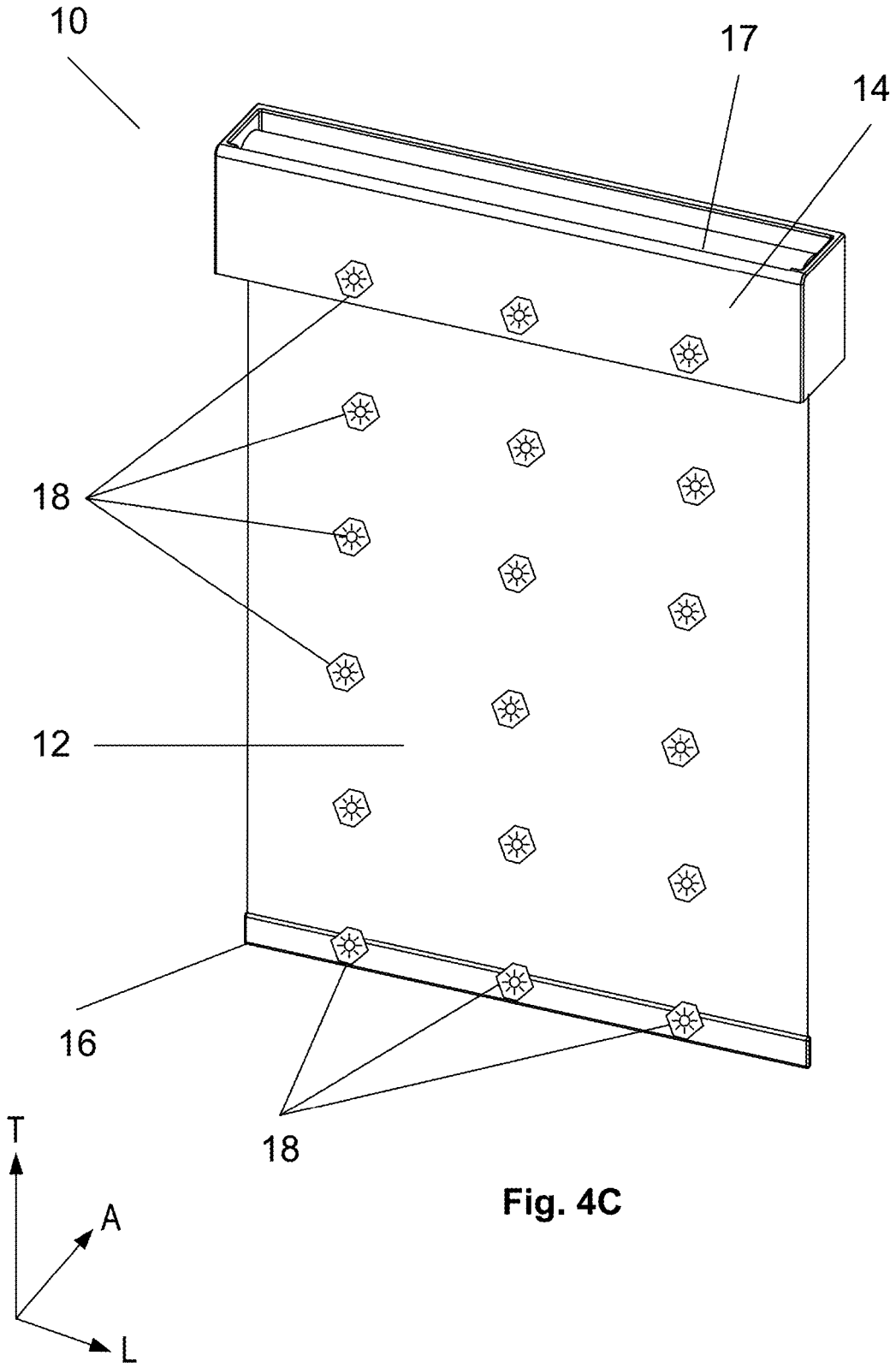
FIG. 4C is a backside perspective view of another embodiment of a window treatment with the light source attached to the headrail, covering material, and bottom bar.

FIGS. 3A-3B illustrate a side-view of the window treatment 10 mounted to the structure 28 adjacent the window 20. FIGS. 3A-3B illustrate how the first and second transparencies may occur during a specified astronomical time range. As shown in FIG. 3A, when the sun has set, the covering material 12 can be configured to have the first transparency whereby visualization through the covering material 12 from the exterior space is permitted. The covering material 12 can achieve the first transparency because an interior light 40 that illuminates the interior space and thus the first side of the covering material 12 is brighter than ambient light 46 (e.g. the moon) that illuminates the exterior space visualization through the covering material 12 from the exterior space to the interior space may be permitted. That is, because the ambient light on the first side of the covering material 12 is greater than the ambient light on the second side of the covering material 12, an individual 44 in the exterior space may be permitted to visualize or otherwise see into the interior space, as illustrated by first visualization line 30.

As illustrated in FIG. 3B, when the sun has set and the light source 18 is illuminated, the covering material 12 can be further configured to have a second transparency whereby visualization through the covering material 12 from the exterior space is impeded relative to the first transparency. The covering material 12 can achieve the second transparency because when the light source 18 illuminates the second side of the covering material 12 the ambient light on the second side of the covering material 12 may now be greater than the ambient light on the first side of the covering material 12. In this way, the individual 44 in the exterior space may be impeded from visualizing the interior space through the covering material 12, as illustrated by second visualization line 32.

The first and second transparencies may occur during a specified astronomical time range, such as from sunset to sunrise. However, it should be appreciated that the first and second transparencies can occur during any astronomical time range, as desired. For example, there may be a time between sunrise and sunset that clouds in the sky cause the amount of the ambient light 46 that illuminates the second side of the covering material 12 to be less than the amount of light on the first side of the covering material 12. In this manner, the covering material 12 may achieve the first transparency during a time range that is between sunrise and sunset. It should also be appreciated that the first transparency can be achieved for a variety of other reasons between sunrise and sunset, such as a solar eclipse, stormy weather, or anything else that may decrease the amount of the ambient light 46 that illuminates the second side of the covering material 12 with respect to the ambient light on the first side of the covering material 12. In such situations, the second transparency can be achieved during any astronomical time range when the light source 18 illuminates the second side of the covering material 12, such that the ambient light on the second side is greater than the ambient light on the first side of the covering material 12.

As shown in FIGS. 1 and 4A-4C, the light source 18 can be coupled to any part of the window treatment 10, structure 28, or window 20. For example, in the embodiment illustrated in FIG. 4A, the light source 18 can be attached to the bottom bar 16 and the light source 18 can span across at least a portion of the bottom bar 16 along the first direction L. In the embodiment shown in FIG. 4B, the light source 18 can be coupled to the covering material 12 and the light source 18 can span across at least a portion of the covering material 12 along the first direction L and/or the second direction T. In the embodiment shown in FIG. 4C, the light source 18 can be coupled to the headrail 14, covering material 12, and bottom bar 16. While not illustrated in FIGS. 4A-4C, the light source 18 can further be configured to couple to the structure 28 or the window 20 adjacent the window treatment 10. It should be appreciated that the light source 18 can be coupled to at least one of the headrail 14, covering material 12, bottom bar 16, structure 28, the window 20, or any of these in combination.

Furthermore, the light source 18 may be coupled to the window treatment 10, structure 28, and window 20 at a location that is easily accessible to the user. In this manner, if the light source 18 requires replacement for any reason, the user may have easy access to the light source 18. Furthermore, it should be appreciated that the light source 18 may be easily coupled or decoupled from the window treatment 10, structure 28, and window 20, which may assist in replacement of the light source 18. The light source 18 may also be configured to be aimed to a different location if necessary. In this manner, if the user notices that the light source 18 is not shining in the proper direction, or the light source 18 is not achieving the specified illumination of the second side of the covering material 12, then the light source 18 may be re-aimed to achieve the desired qualities. As well, it should be appreciated that the light source 18 may be configured to be relocated to different locations on the window treatment 10, structure 28, and window 20. For example, the light source 18 can be coupled to a window sill. In this manner, the light source 18 could illuminate the covering material 12 adjacent the bottom end of the covering material 12.

The window treatment 10 can further include a motor (e.g., motor 160 shown in FIG. 7) operatively coupled to the covering material 12. In this manner, the motor can actuate the movement of the covering material 12 between the fully-open and the fully-closed position. The motor 60 can be housed within an internal cavity 17 of the headrail 14.

The window treatment 10 can further include at least one battery (e.g. four D-cell batteries that may be electrically coupled in series). The at least one battery can be coupled to the motor and/or the light source 18 and can be configured to power the motor 60 and/or the light source 18. The at least one battery can be housed within an internal cavity 17 of the headrail 14 so as to be out of view of the user of the window treatment 10. It should also be appreciated that the window treatment 10 and in particular the motor and/or light source 18 can be powered via an electrical cord coupled to an alternating-current (AC) or direct-current (DC) power source as desired. Therefore, it should be appreciated, that the motor 60 and/or light source 18 can be powered using any power source as desired.

Figure 5:
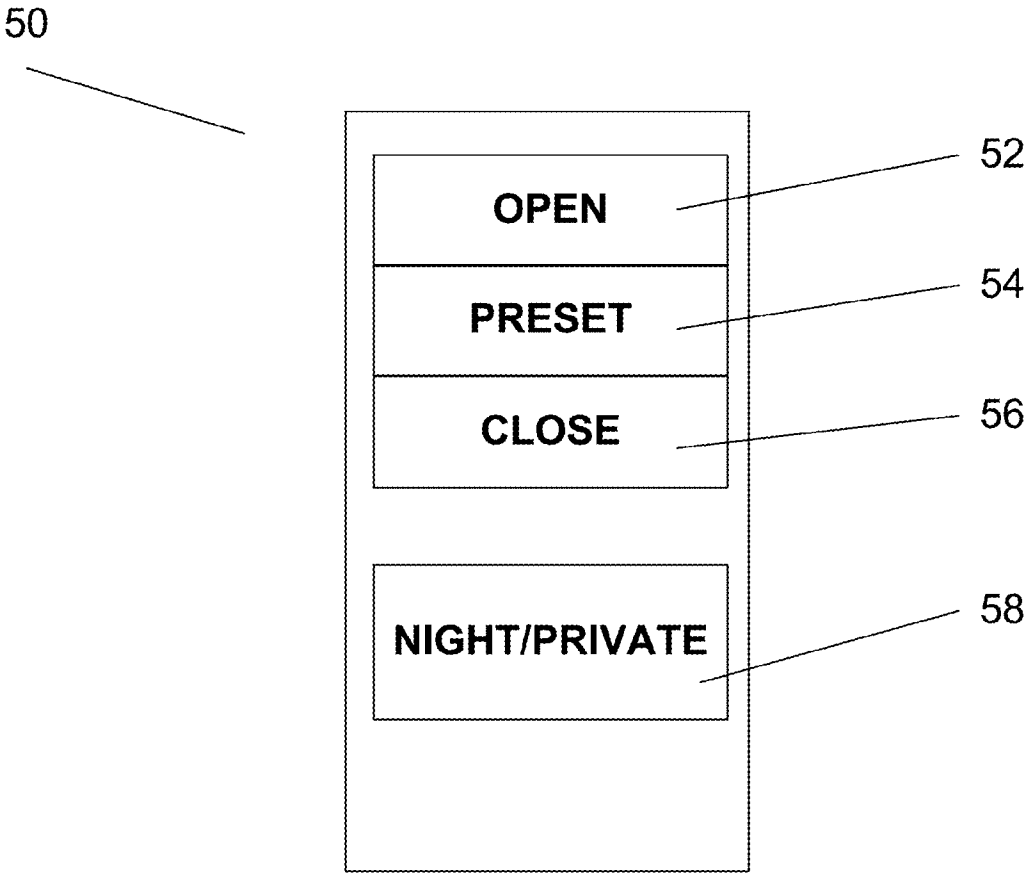
FIG. 5 is a top-down view of a shade controller configured to control the light source, the shade controller including Open, Preset, Closed, and Night/Private buttons.

It should be appreciated that there are numerous ways to actuate the motor and illuminate the light source 18. For example, the motor of the window treatment 10 may be controlled in response to a remote control device 50 that may also control the light source 18. As shown in FIG. 5, the remote control device 50 comprise a number of buttons (e.g., an open button 52, a preset button 54, a close button 56, and a night/private button 58) to allow for the transmission of a number of respective commands, such as an open command, a preset command, a close command, and a night/private command. The commands can be configured to control the window treatment 10 in the following manner. If the covering material 12 is in the lowered position and the user pushes the open button 52, the remote control device 50 may instruct the motor to rotate in a first direction to thereby raise the covering material 12 to the raised position. If the covering material 12 is in the raised position and the user pushes for example the close button 56, the remote control device 50 may instruct the motor to rotate in a second direction to thereby lower the covering material 12 to the lowered position. The preset button 54 may cause the remote control device 50 to instruct the motor to move the covering material 12 to a desired preset position. If the user wishes to achieve the first or second transparency, the user may push the night/private button 58, which may cause the remote control device 50 to adjust the illumination level of the light source 18 to achieve the first or second transparency. In some embodiments, the night/private button could select a night/private "scene" or "preset". Accordingly, in response to a command such as pressing the night/private button 58 on the remote control, the motor could lower the covering material 12, and the light source 18 could also be illuminated. It should be appreciated that this could be implemented through both of the systems of FIGS. 7-8, as described below.

Figure 6:
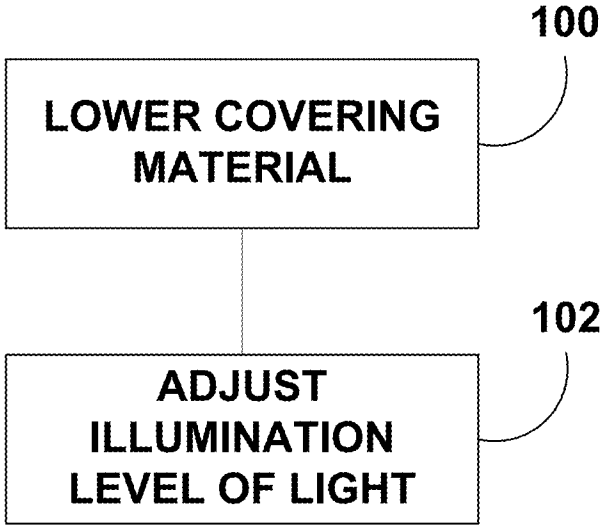
FIG. 6 is a flow-chart illustrating a method of lowering the covering material, adjusting the illumination level of the light, and causing visualization to be impeded.

FIG. 6 is a flowchart illustrating a method of adjusting the transparency of the covering material 12 of the window treatment 10 (e.g., in response to the actuation of the night/private button 58 of the remote control device 50. The method may include lowering the covering material 12 from a raised position to a lowered position such that the covering material 12 covers a substantial portion of the window 20 (at step 100). The covering material 12 may have a transparency such that during a time range after sunset and before sunrise, visualization through the covering material 12 from the exterior space may be permitted. The method may also include adjusting an illumination level of the light source 18 that is attached to the window treatment 10 (at step 102). In this manner, the ambient light 46 on the second side of the covering material 12 may be greater than that on the first side of the covering material 12. It should be appreciated that in some embodiments, the lowering step 100 and the adjusting step 102 could occur automatically at sunset.

Figure 7:
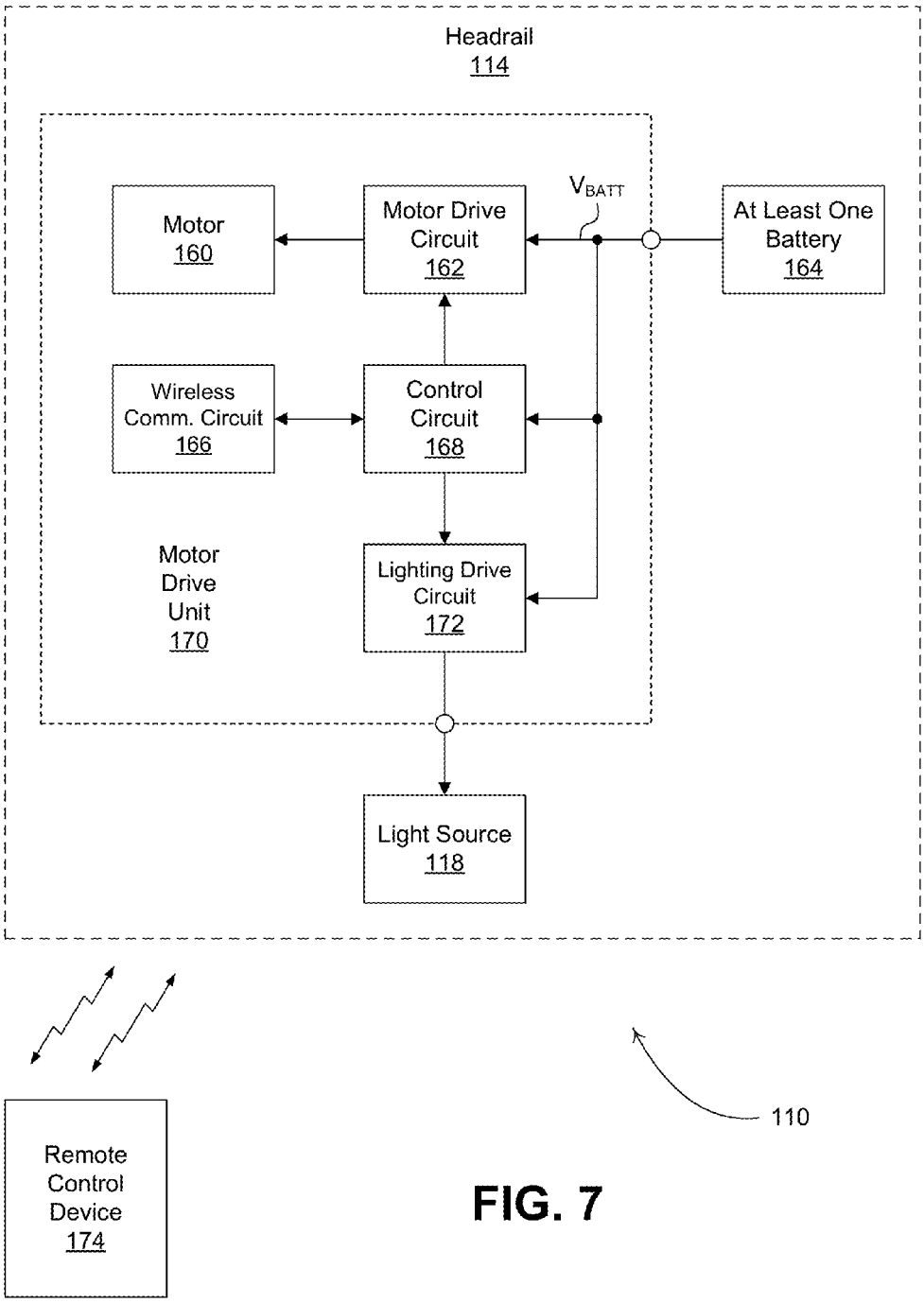
FIG. 7 is a block diagram of an example of a system that may include a controller.

FIG. 7 shows an example block diagram of a system that may include a window treatment 110 controlled in response to wireless signals transmitted directly from a remote control device 174 (e.g., the remote control device 50 shown in FIG. 5). The window treatment 110 may include a roller tube and a motor drive unit 170 located inside the roller tube. The motor drive unit 170 may be powered by a battery voltage $V_{BATT}$ received from at least one battery 164 located, for example, outside the roller tube. The motor drive unit 170 may include a motor drive circuit 162 for controlling a motor 160, and an integral lighting drive circuit 172 for controlling a light source 118 (e.g., one or more of the light sources 18 shown in FIG. 1), which may be mounted to a headrail 114 (e.g., the headrail 14 shown in FIGS. 1 and 7). For example, the lighting drive circuit 172 may comprise a dimmer circuit for an incandescent lamp or an LED driver circuit for an LED light source. The motor drive unit 170 may comprise a control circuit 168 for controlling both the motor drive circuit 162 and the lighting drive circuit 172, and a wireless communication circuit 166 for receiving wireless signals, e.g., radio-frequency (RF) or infrared (IR) signals, from the remote control device 174.

The system of FIG. 7 could be used to control a roller shade preinstalled in a cassette (as shown in FIG. 1) where the at least one battery 164 and the light source 118 are mounted to the cassette. In this manner, the user might only have to install the cassette, whereby the system would be functional. Alternatively, the user could mount a roller shade in a pocket (e.g., in the headrail 14, 114), mount a light source (e.g., the light sources 18, 118) to the headrail 14, and then electrically connect the light sources to the motor drive unit of the roller shade.

Figure 8:
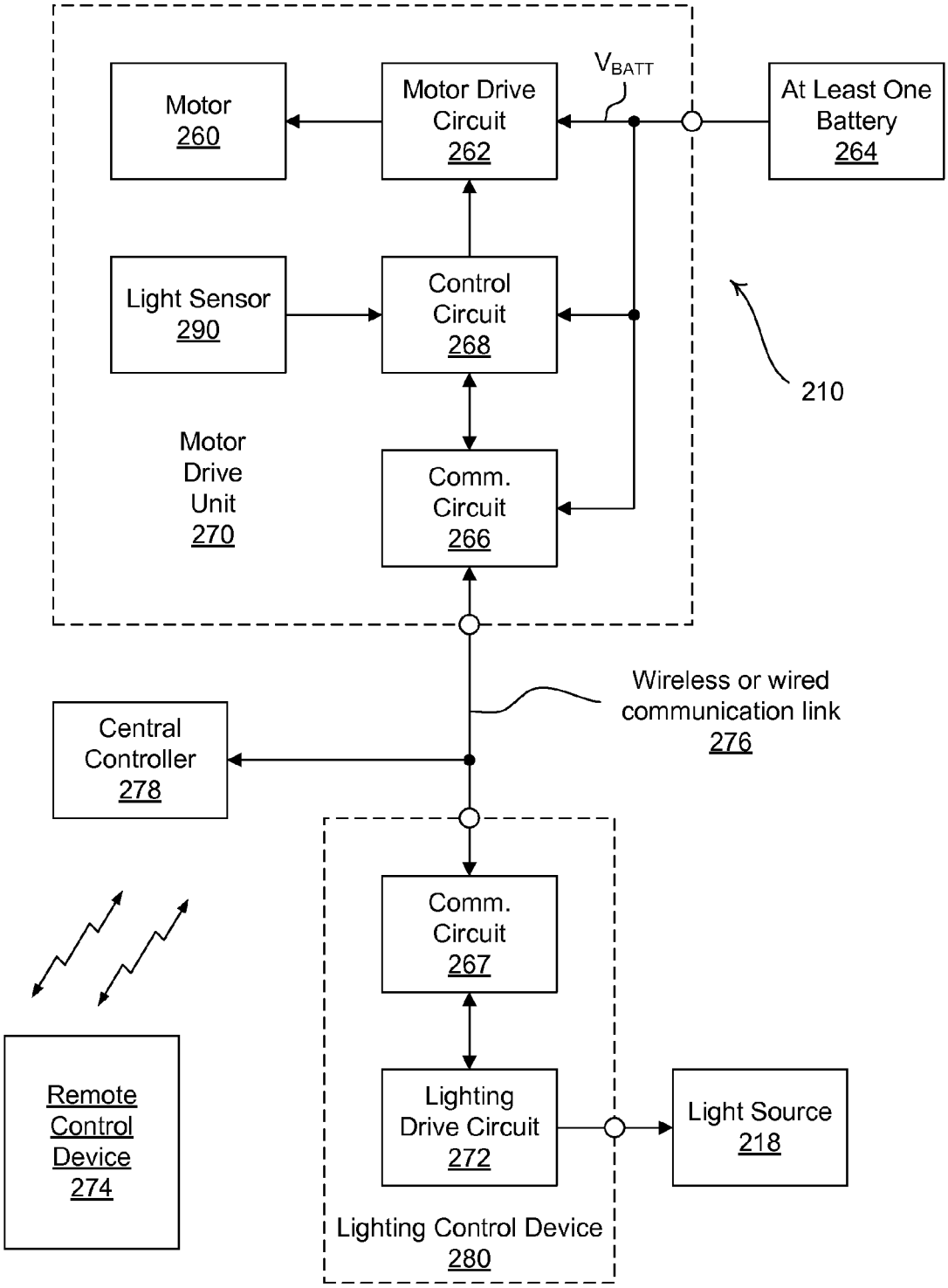
FIG. 8 is a block diagram of an example of another system.

FIG. 8 shows an example block diagram of a system having a window treatment 210 including a roller tube and a motor drive unit 270 may be able to communicate with a lighting control device 280 (e.g., a dimmer switch) via a wireless or wired communication link 276. The motor drive unit 270 may be powered by a battery voltage VBATT received from at least one battery 264 located, for example, outside the roller tube. The motor drive unit 270 comprises a control circuit 268 and a communication circuit 266 for transmitting and receiving digital messages via the communication link 276. The lighting control device 280 comprises a lighting drive circuit 272 for controlling a light source 218 (e.g., one or more of the light sources 18 shown in FIG. 1) and a communication circuit 267 for transmitting and receiving digital messages via the communication link 276. The light source 218 could be mounted to a headrail (e.g., the headrail 14) or anywhere around a window (e.g., the window 20) to illuminate a covering material of the window treatment (e.g., the covering material 12).

The system might also comprise a central controller 278 that is able to communicate via the communication link 276. The central controller 278 could receive wireless signals (e.g., RF or IR signals) from a remote control device 274 (e.g., the remote control device 50 shown in FIG. 5) and logically decide how to control the motor drive unit 270 and the lighting control device 280. Alternatively, the remote control device 274 could transmit the wireless signals to one or both of the communication circuit 266 of the motor drive unit 270 and/or the communication circuit 267 of the lighting control device 280. In this manner, each of the motor drive unit 270 and the lighting control device 280 could logically respond. For example, the motor drive unit 270 could respond by actuating a motor 260 via a motor drive circuit 262 to lower the covering material, and the lighting control device 280 could respond by illuminating the light source 218. These are just a few examples of how the motor drive unit 270 and lighting control device 280 could respond.

The central controller 278 may also be configured to automatically adjust the illumination level of the light source 218 based on time of day. In this manner, the central controller 278 may instruct the motor drive unit 270 to adjust the position of the covering material and the lighting control device 280 to adjust the illumination level of the light source 218 at a predetermined time of the day. For example, the central controller 278 may instruct the motor drive unit 270 to lower the covering material and the lighting control device 280 to turn on the light source 218 at 7:00 pm to thereby achieve the second transparency. The central controller 278 may further instruct the motor drive unit 270 to raise the covering material and the lighting control device 280 to turn off the light source 218 at 11:00 pm. It should be appreciated that the central controller 278 may be configured to instruct the motor drive unit 270 to adjust the position of the covering material and the lighting control device 280 to adjust the illumination level of the light source 218 at any time of day or for any amount of time as desired.

The central controller 278 can be configured to control the lighting control device 280 such that the light source 218 turns on and illuminates the second side of the covering material and can be configured to control the lighting control device such that the light source turns off and no longer illuminates the second side of the covering material. It should be appreciated, however, that the central controller 278 can be configured to control the lighting control device 280 to adjust the level of illumination of the light source 218 for example by dimming the light source 218 to any level between full illumination and off.

The motor drive unit 270 of the window treatment 210 may further include a light sensor 290 that is operatively coupled to the control circuit 268. The light sensor 290 may be configured to detect the illumination level of the ambient light on the second side of the covering material. In this manner, when the illumination level of the ambient light meets a predetermined level, the control circuit 268 may instruct the lighting control device 280 to turn on or turn off the light source 218. It should be appreciated that the lighting control device 280 may be instructed to control the light source 218 to any of the illumination levels as previously described. It should also be appreciated that the light sensor 290 could be coupled to the window treatment 210 or alternatively be coupled to any structure either in the interior space or in the exterior space as desired.

While the disclosure discusses impeding the individual 44, who is located in the exterior space, from seeing into the interior space, it should also be appreciated that the opposite can be achieved as well. In this manner, the systems and methods described can also be used to impede the user 22 located within the interior space from seeing the exterior space. In similar fashion, the window treatment 10 could also be coupled to a window that separates two adjacent interior spaces, such as an internal window within a home. In this example, the window treatment 10 could be mounted to cover the internal window. In this manner the window treatment 10 could impede visualization between either interior space.

While the foregoing description and drawings represent the preferred embodiment of the present invention, it will be understood that various additions, modifications, combinations and/or substitutions may be made therein without departing from the spirit and scope of the invention as defined in the accompanying claims. In particular, it will be clear to those skilled in the art that the invention may be embodied in other specific forms, structures, arrangements, proportions, and with other elements, materials, and components, without departing from the spirit or essential characteristics thereof. One skilled in the art will appreciate that the invention may be used with many modifications of structure, arrangement, proportions, materials, and components, which are particularly adapted to specific environments and operative requirements without departing from the principles of the invention. In addition, features described herein may be used singularly or in combination with other features. For example, features described in connection with one component may be used and/or interchanged with features described in another component. The presently disclosed embodiment is therefore to be considered in all respects as illustrative and not restrictive, the scope of the invention being indicated by the appended claims, and not limited to the foregoing description.

It will be appreciated by those skilled in the art that various modifications and alterations of the invention can be made without departing from the broad scope of the appended claims. Some of these have been discussed above and others will be apparent to those skilled in the art.

What is claimed:

1. A window treatment system configured to selectively cover a window that separates an exterior space from an interior space, the window treatment system comprising:

a headrail that is elongate along a first direction and is configured to be coupled to a structure adjacent the window within the interior space;

a covering material having a top end and a bottom end that is spaced from the top end along a second direction that is perpendicular to the first direction, the top end of the covering material being operatively attached to the headrail such that the covering material is movable along the second direction between a raised position and a lowered position, the covering material further having a first side and a second side that is opposite the first side and faces the window when the headrail is coupled to the structure;

a light source that is configured to illuminate at least a portion of the second side of the covering material;

a light sensor that is configured to detect an ambient light level on the second side of the covering material; and a control circuit that is operatively coupled to the light sensor and the light source, the control circuit configured to, when an ambient light level on the first side of the covering material exceeds the detected ambient light level on the second side of the covering material such that visualization through the covering material from the exterior space into the interior space is permitted, cause the light source to illuminate the at least a portion of the second side of the covering material so as to impede visualization through the covering material from the exterior space into the interior space.

2. The window treatment system of claim 1, wherein the control circuit is further configured to cause the light source to illuminate the second side of the covering material during an astronomical time range that is defined from about sunset to about sunrise.

3. The window treatment system of claim 1, wherein the light source includes a plurality of light emitting diodes.

4. The window treatment system of claim 1, wherein the light source is attached to the headrail such that when the headrail is coupled to the structure, the light source is located between the covering material and the window.

5. The window treatment system of claim 1, wherein the light source is attached to the covering material.

6. The window treatment system of claim 1, further comprising a bottom bar attached to the bottom end of the covering material, wherein the light source is attached to the bottom bar and spans across at least a portion of the bottom bar along the first direction.

7. The window treatment system of claim 1, wherein the control circuit is further configured to adjust an illumination level of the light source based on a time of day.

8. The window treatment system of claim 1, further comprising:

a motor that is operatively coupled to the covering material, wherein the control circuit is further configured to drive the motor in response to receipt of a signal, to thereby move the covering material between the lowered position and the raised position.

9. The window treatment system of claim 8, wherein the control circuit is further configured to adjust an illumination level of the light source in response to the signal.

10. The window treatment system of claim 9, wherein the signal comprises a wireless signal, and wherein the window treatment system further comprises a communication circuit that is configured to receive the wireless signal.

11. The window treatment system of claim 1, wherein the light source is configured to illuminate at least 51% of the second side of the covering material when the covering material is in the lowered position.

12. The window treatment system of claim 11, wherein the light source is configured to illuminate at least 75% of the second side of the covering material when the covering material is in the lowered position.

13. The window treatment system of claim 12, wherein the light source is configured to illuminate about 100% of the second side of the covering material when the covering material is in the lowered position.

* * * * *